US007048162B2

(12) United States Patent
Frye et al.

(10) Patent No.: US 7,048,162 B2
(45) Date of Patent: May 23, 2006

(54) HANDS-FREE FOREARM CARRIER OF ARTICLES

(75) Inventors: Rebecca Rachael Frye, Worcester, MA (US); Daniel Clark Hartwell, Worcester, MA (US)

(73) Assignee: Rebecca Rachael Designs, Worcester, MA (US)

( * ) Notice: Subject to any disclaimer, the term of this patent is extended or adjusted under 35 U.S.C. 154(b) by 134 days.

(21) Appl. No.: 10/643,830

(22) Filed: Aug. 19, 2003

(65) Prior Publication Data

US 2005/0040194 A1 Feb. 24, 2005

(51) Int. Cl.
*A45C 13/30* (2006.01)

(52) U.S. Cl. ..... 224/222; 224/223; 206/373

(58) Field of Classification Search ..... 224/219, 224/222, 223; 206/372, 373
See application file for complete search history.

(56) References Cited

U.S. PATENT DOCUMENTS 2,265,094 A * 12/1941 Wolfe ..... 359/879
2,465,946 A * 3/1949 Velez ..... 132/315
4,069,954 A * 1/1978 Rauch ..... 224/219
D258,246 S * 2/1981 Kravchenko ..... D3/230
4,765,472 A * 8/1988 Dent ..... 206/373
4,852,782 A * 8/1989 Wu et al. ..... 224/661
4,901,464 A * 2/1990 Banoun ..... 42/95
4,988,097 A 1/1991 Smith et al.
5,020,711 A * 6/1991 Kelley ..... 224/222
D320,307 S 10/1991 Walasek
5,154,506 A * 10/1992 Leard ..... 362/103
5,205,449 A 4/1993 Davies
5,309,328 A 5/1994 Lum
5,400,936 A 3/1995 Jones et al.
D374,767 S 10/1996 Leach
5,657,201 A 8/1997 Kochis
D382,995 S 9/1997 Hale
5,671,481 A * 9/1997 Giard ..... 2/170
5,683,022 A 11/1997 Evans
5,752,633 A * 5/1998 Antaki ..... 224/222
5,842,584 A * 12/1998 Baird ..... 211/69.1
D404,908 S 2/1999 Lollis
5,881,734 A * 3/1999 Trayes ..... 132/73
5,894,971 A * 4/1999 Huang ..... 224/218
6,062,447 A 5/2000 Longley (Continued)

FOREIGN PATENT DOCUMENTS

GB 2328371 A 2/1999

OTHER PUBLICATIONS

Clarins Paris, "New Instant Light Perfecting Touch 'Beauty Band-Aid' Retail Driving Animation," undated, 1 pg.

(Continued)

*Primary Examiner*—Stephen K. Cronin
(74) *Attorney, Agent, or Firm*—Guerin&Rodriguez,LLP; Michael A. Rodriguez

(57) ABSTRACT

Described is a carrier of articles for wearing around a forearm. The carrier includes a carrier body having a top side, a center portion, and an end portion on each side of the center portion. The carrier also includes means for fastening the end portions to each other when the end portions are wrapped around opposite sides of the forearm to secure the carrier to the forearm. A strap extends across at least a portion of the top side of the carrier body and is attached to the top side at a plurality of locations such that a compartment is defined for receiving and holding an article between the strap and the center portion.

22 Claims, 5 Drawing Sheets

U.S. PATENT DOCUMENTS

| | | | | |
|---|---|---|---|---|
| 6,070,825 | A | 6/2000 | Rich | |
| 6,227,424 | B1 * | 5/2001 | Roegner | 224/219 |
| 6,330,961 | B1 | 12/2001 | Borja | |
| 6,360,928 | B1 | 3/2002 | Russo | |
| 6,364,183 | B1 | 4/2002 | Barnard | |
| 6,398,092 | B1 | 6/2002 | Ansley | |
| 6,425,137 | B1 * | 7/2002 | Fakhrai | 2/170 |
| 6,443,341 | B1 | 9/2002 | Rittmann | |
| D471,706 | S | 3/2003 | Campagna et al. | |

OTHER PUBLICATIONS

Brushes by Karen Inc., "Cosmetic Bags & Brush Kits," Web site visited Jul. 10, 2003, 8 pages.

Mantis Design Group, The Mantis Glove, Web site visited Jun. 28, 2005, 3 pages.

* cited by examiner

HANDS-FREE FOREARM CARRIER OF ARTICLES

FIELD OF THE INVENTION

The invention relates to hands-free article carriers worn on a forearm of a user.

BACKGROUND

Those who work with their hands often have more tools to work with than hands to hold them. When hands are full, picking up one tool requires that another be put down. Often, an individual will set the tool on a nearby table top, or, depending upon the type of tool, place it in a pocket or attach it to an article of clothing. Hairdressers, for example, frequently clip bobby pins and hair clips to their clothing when working with a client.

Typically during the course of performing the task, the need arises to use a tool that has been set down. However, the individual often does not immediately remember where she set the tool or finds that she has moved away from easy reach of the tool and must now stretch, turn, bend, or move back to reach it. Aside from being inconvenient and causing fatigue and frustration, these various movements can make individuals who work personally with their clients, such as make-up artists, hairdressers and cosmetologists, appear unprofessional and disorganized. Accordingly, there is a need for an apparatus that permits individuals to have their hands free to serve their clients, but keeps handy the tools of their trades.

SUMMARY

In one aspect, the invention features a carrier of articles for wearing around a forearm. Described is a carrier of articles for wearing around a forearm. The carrier includes a carrier body having a top side, a center portion, and an end portion on each side of the center portion. The carrier also includes means for fastening the end portions to each other when the end portions are wrapped around opposite sides of the forearm to secure the carrier to the forearm. A strap extends across at least a portion of the top side of the carrier body and is attached to the top side at a plurality of locations such that a compartment is defined for receiving and holding an article between the strap and the center portion.

In another aspect, the invention features a carrier of articles for wearing around a forearm. The carrier includes means for providing a carrier body having a top side, a center portion, and an end portion on each side of the center portion, means for fastening the end portions to each other when the end portions are wrapped around opposite sides of the forearm to secure the carrier to the forearm, and strap means, attached to the top side of the carrier body, for receiving and holding an article between the strap means and the center portion.

In yet another aspect, the invention features a method for constructing a hands-free carrier for wearing around a forearm. A carrier body, having a top side, an underside, a center portion, and an end portion of each side of the center portion, is provided. Means for fastening are attached on the top side of an end portion of the carrier body and on the underside of a second end portion of the carrier body. A strap is attached across the top side of the carrier body at a plurality of locations to produce a compartment for receiving and holding an article between the strap and the center portion.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

The present invention features a hands-free carrier for use by individuals, such as manicurists, hairdressers, make-up artists, cosmetologists, dental assistants, medical assistants, and the like, who work with their hands and often switch among various articles or tools in the course of providing their services. The carrier of the invention gives these individuals a mechanism for organizing their tools and keeping them in ready position for when they are needed.

Figure 1:
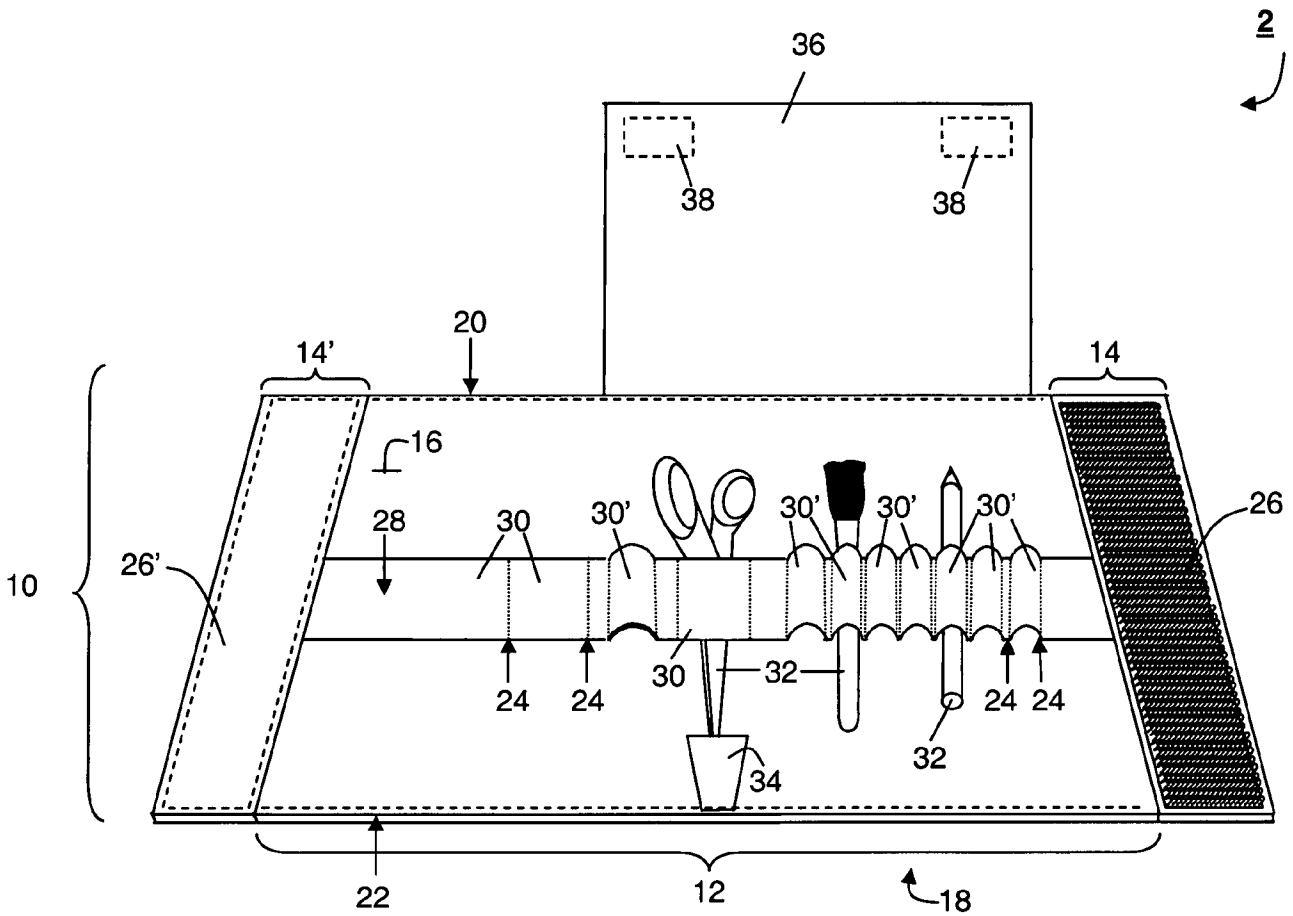
FIG. 1 is a plan view of an embodiment of a hands-free forearm carrier of the present invention.

FIG. 1 shows an embodiment of a hands-free forearm carrier 2 constructed in accordance with the invention. The carrier 2 includes a canier body 10 having a center portion 12, a right and left end portions 14, 14' on respective sides of the center portion 12, a top side 16 and an underside 18, a front edge 20 and a back edge 22. The size of the carrier 2 can be tailored for different forearm sizes, for the size of the articles to be carried, or both. In this embodiment, the front edge 20 is shorter in length than the back edge 22; thus, the shape of the carrier 2 is generally trapezoidal. The trapezoidal shape provides a greater overlap between end portions 14, 14' than rectangular shapes (see FIG. 4), for medium to large forearms in particular, when the carrier 2 is wrapped around the forearm.

Each end portion 14, 14' has means for fastening 26, 26', respectively, to the other end portion 14', 14. In one embodiment, the means for fastening 26 includes hook-and-loop material (e.g., VELCRO®). One component (i.e., hook or loop) of this material is attached to the top side 16 of the right end portion 14 and the corresponding mating component is attached to the underside 18 of the left end portion 14'. The placement of the hook-and-loop material on the top side 16 and underside 18 can be reversed; that is, one component is attached to the top side 16 of the left end portion 14' and the corresponding mating component is attached to the underside 18 of the right end portion 14. Preferably, the hook component of the hook-and-loop material is attached to the top side 16 so that when the carrier 2 is wrapped around the forearm, the hook structures, which may be abrasive to the skin, face away from the surface of the forearm.

To produce an adequate attachment between the end portions 14, 14', the hook-and-loop material covers most of the end portion 14, 14'. One of ordinary skill in the art will recognize that other means for fastening together the end portions 14, 14' can be used without departing from the principles of the invention. Examples of other fastener means include, but are not limited to, snaps, clasps, latches, hooks, belts and buckles, and zippers.

Extending laterally across the top side 16 of the center portion 12 and attached (i.e., stitched or sewn) at various places 24 to the center portion 12 is a strap 28. These places 24 of attachment to the carrier body 10 form various compartments 30, 30' (generally 30) for holding articles or tools 32. In general, to place an article 32 (e.g., haircutting shears or eyeliner pencils) into one of the compartments 30, a user slides the article 32 between the strap 28 and the top side 16 of the center portion 12. For some types of articles, such as bobby pins and hair clips, the strap 28 provides an edge to which the user can clip the article. Typically, a portion of the article 32 remains outside of the compartment 30 so that the user can readily grasp and remove the article 32.

In one embodiment, the strap 28 is made of elastic material. The elasticity of the strap 28 holds the articles 32 firmly against the center portion 12. Non-elastic embodiments of the strap 28 (e.g., strings, belts, bands) can be used without departing from the principles of the invention, provided the strap 28 when attached to the carrier body 10 is sufficiently taut to hold the articles 32 securely against the top side 16 of the center portion 12.

Figure 6:
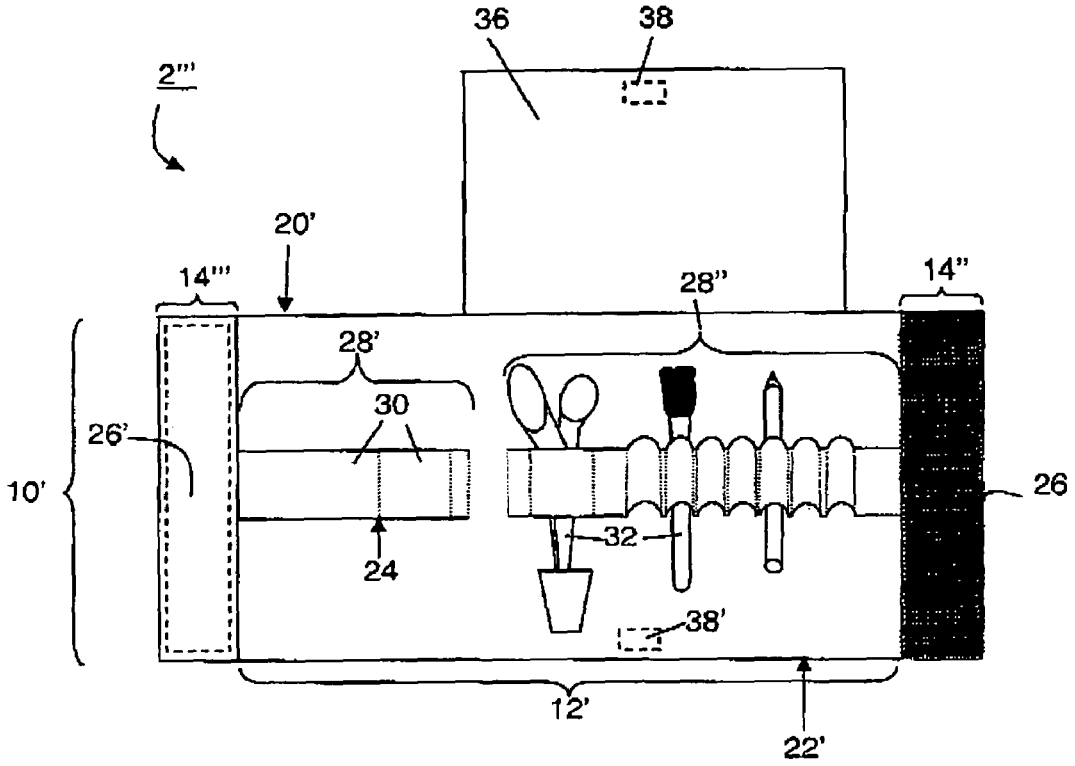
FIG. 6 is a plan view of another embodiment of a hands-free forearm carrier.

Preferably, the strap 28 extends laterally across the center portion 12 (i.e., substantially parallel to the front edge 20). In another embodiment, the strap 28 extends vertically across the center portion 12 (i.e., perpendicular to the front edge 20). Various embodiments of the carrier 2 have straps of different length and in different numbers. For example, in one embodiment, the strap 28 extends across the entire width of the center portion 12 and is attached at the interfaces between the end portions 14, 14' and the center portion 12. In another embodiment, the strap 28 does not fully extend across of the center portion 12; that is, the strap 28 is shorter in length than the width of the center portion 12. In yet another embodiment, shown in FIG. 6, multiple straps (28', 28") extend laterally across the center portion 12. Such straps can be laterally or vertically aligned with each other on the top side 16 of the center portion 12, laterally or vertically offset from each others (i.e., some nearer or farther from the front or back edges 20, 22 of the center portion 12), or combinations thereof.

Typical embodiments of the forearm carrier 2 have as few as one compartment 30 and as many as twenty, although embodiments with more than one compartment 30 take fuller advantage of the benefits of the invention and embodiments with more than twenty compartments 30 can be constructed without departing from the principles of the invention.

Compartments 30 can have various sizes or styles. Some compartments 30 are generally flat, for receiving articles 32 such as haircutting shears, bobby pins and hair clips. Other compartments 30' are generally tubular for receiving rounder articles, such as eyeliner pencils, blush brushes and eyebrow brushes. In general, the particular style and sizes of the compartments 30 depend upon the particular use of the forearm carrier 2 (e.g., make up artists, manicurists). In some embodiments, one or more of the compartments 30 are aligned with a pocket 34 for receiving the end of the article 32 held by that compartment 30. The pocket 34 can provide a measure of protection against injury, for example, from a pointed tip of haircutting shears.

Figure 2:
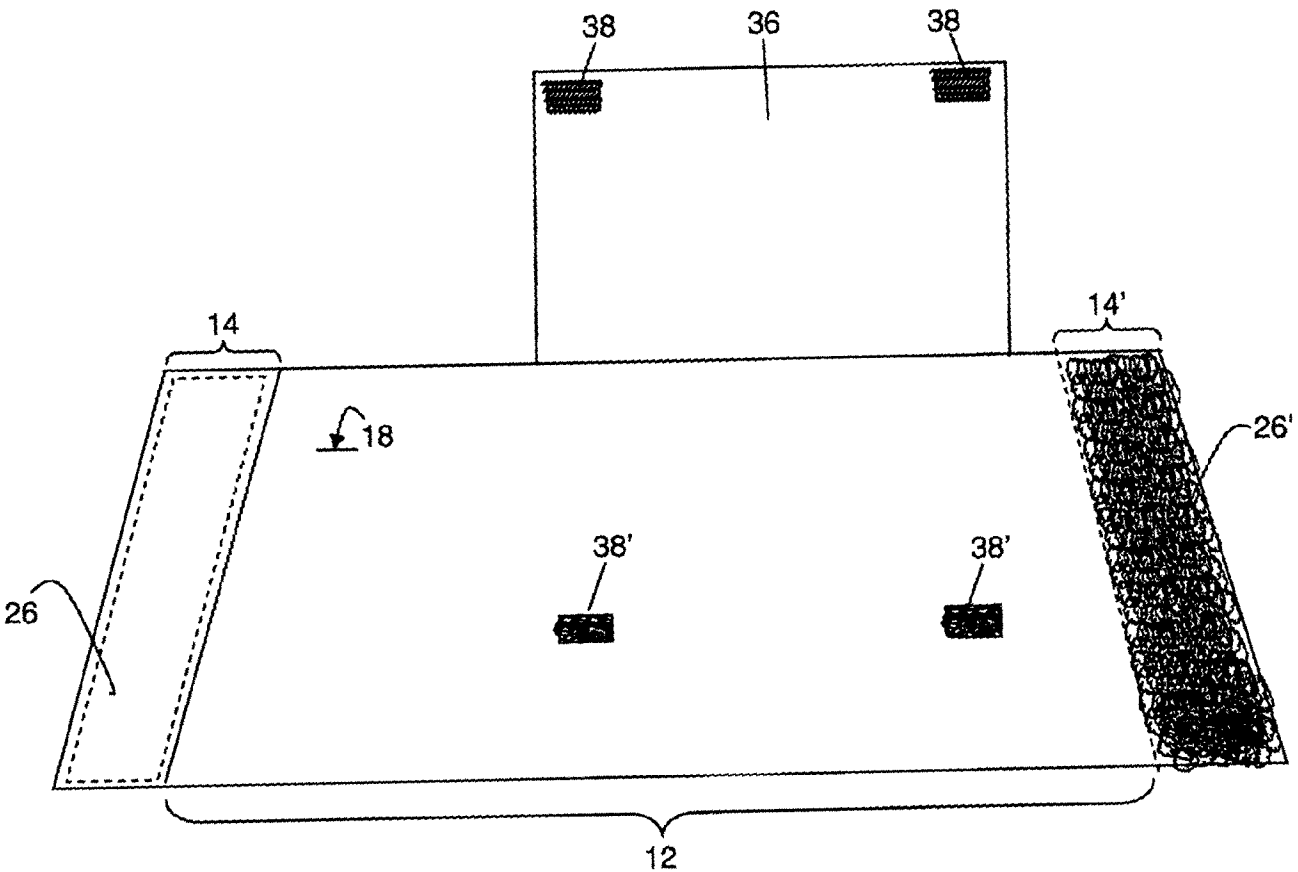
FIG. 2 is a plan view of an underside of the carrier of FIG. 1.

Attached at the front edge 20 of the center portion 12 is an optional protective cover 36 made of soft material that can be folded over the articles 32 (e.g., when the carrier 2 is not being worn and is set on a table top). A fastener (not shown) can be placed on the top side 16 of the center portion 12 and a corresponding fastener (not shown) on the top side of the cover 36 so that the cover 36 can be secured when folded over the articles 32. The cover 36 can be made of various materials, such as, but not limited to, nylon, silk, suede, and leather. Referring also to FIG. 2, the underside of the protective cover 36 has means for fastening 38 the cover 36 to the underside 18 of the center portion 12. Sewn to the underside 22 of the center portion 12 are means for fastening 38' to corresponding fasteners 38 on the underside of the protective cover 36. By use of the fastening means 38, 38' the user can fold under and secure the cover 36 to the center portion 12 when wearing the carrier 2 around the forearm. In one embodiment, the fastening means 38 includes the hook-and-loop material described above.

The carrier body 10 is constructed of layers of various materials sewn together. In one embodiment, a layer of neoprene material is sandwiched between layers of duck cloth. The neoprene material gives the carrier 2 structure that provides a measure of stiffness for supporting the articles 32. The carrier materials are machine-washable. Other materials, such as nylon, leather, suede, vinyl, plastic, and spandex, can also be used to construct other embodiments of the carrier body 10.

Figure 3:
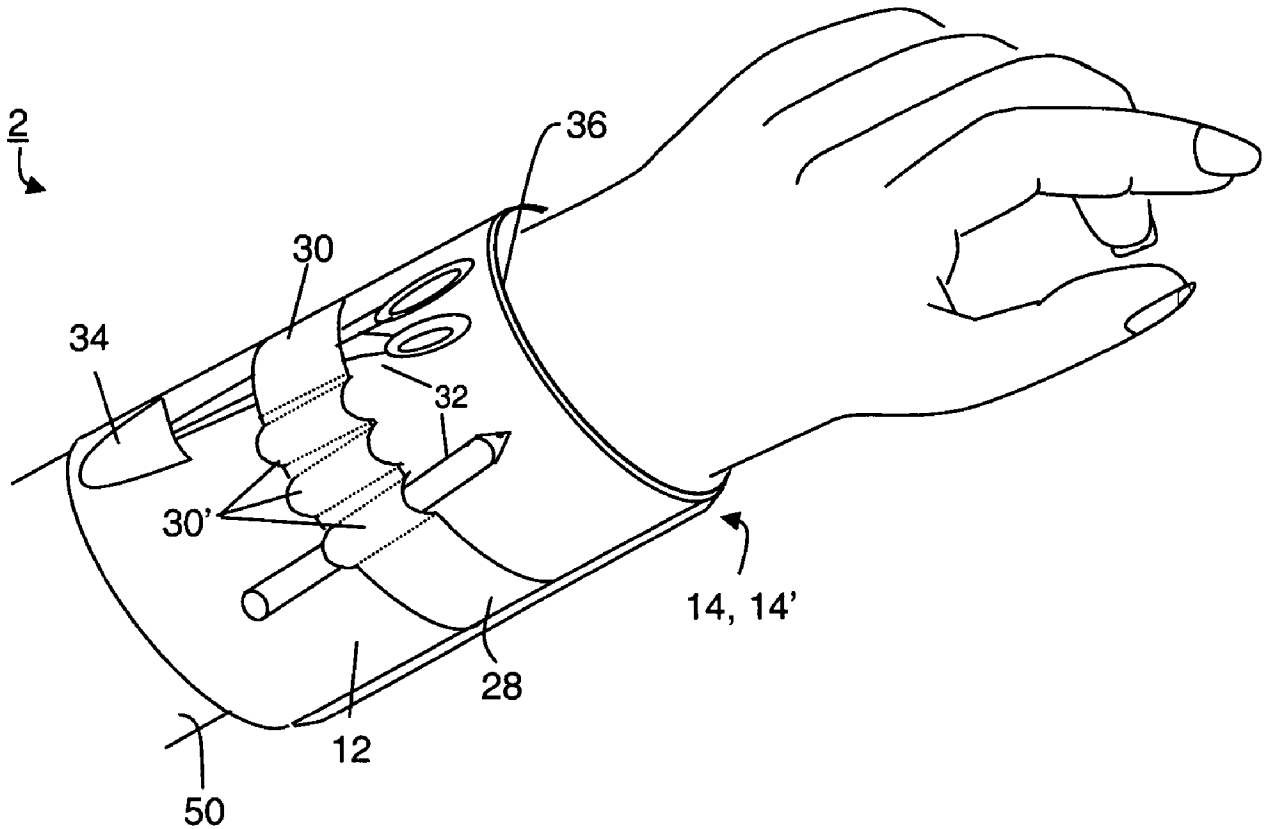
FIG. 3 is a diagram of the forearm carrier being worn around a forearm.

FIG. 3 shows the hands-free forearm carrier 2 being worn around a forearm 50 of a user. Although shown to be worn on the left forearm 50, the forearm carrier 2 can be worn on the right forearm without departing from the principles of the invention. When the carrier 2 is worn, the underside 18 of the center portion 12 faces the forearm, and the protective cover 36 is folded between the center portion 12 and the top surface of the forearm and fastened to the underside 18. In this position, the articles 32 are located on the top side of the forearm, visible to the user, and readily available for use. Further, the hands of the user are thus free to perform the task at hand, including sliding articles 32 into and out of the compartments 30 of the carrier 2.

Figure 4:
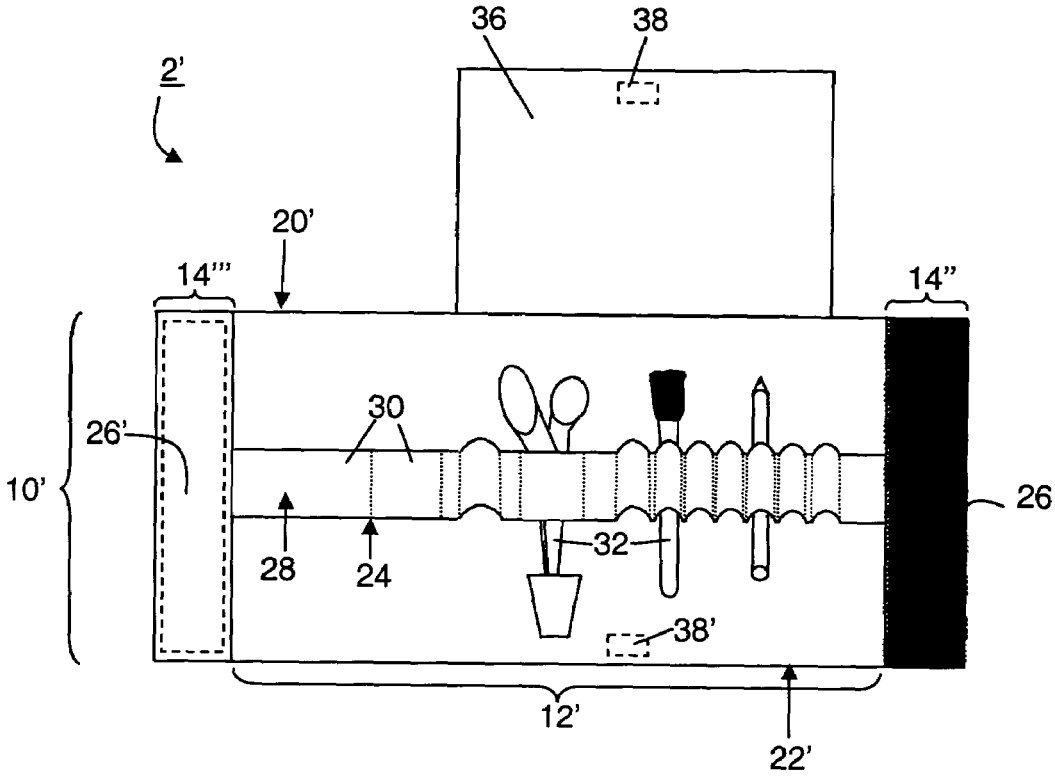
FIG. 4 is a plan view of another embodiment of a hands-free forearm carrier.
Figure 5:
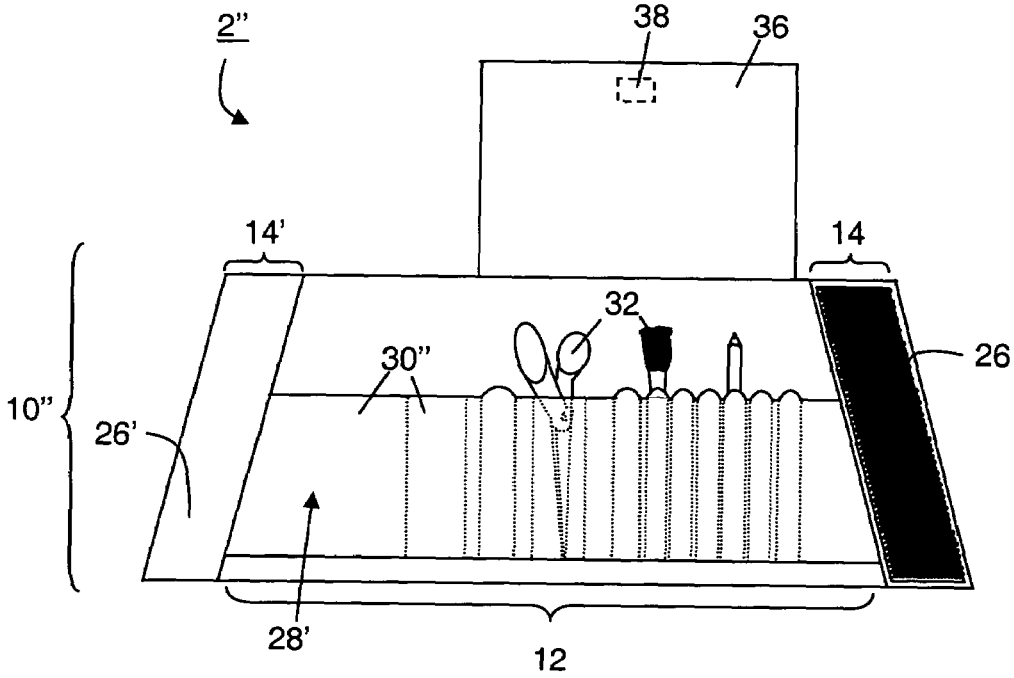
FIG. 5 is a plan view of another embodiment of a hands-free forearm carrier.

While the invention has been shown and described with reference to specific preferred embodiments, it should be understood by those skilled in the art that various changes in form and detail may be made therein without departing from the spirit and scope of the invention as defined by the following claims. For example, FIG. 4 shows another embodiment of a hands-free forearm carrier 2'. In this embodiment, the shape of carrier 2' is generally rectangular, with the front edge 20' and back edge 22' of the center portion 12' being approximately equal to each other in length. Such an embodiment provides adequate securing around small to medium forearms. As another example, FIG. 5 shows an embodiment of a hands-free forearm carrier 2" in which the compartments 30" are pouches or pockets that are open at one end and closed at the other (rather than open at both ends, as shown in FIG. 1). When user inserts an article 32 into a compartment 30", only one end of the article 32 extends out from the cover of the compartment 30".

What is claimed is:

1. A carrier of articles for wearing around a forearm, the carrier comprising:

a carrier body having front and back edges, a top side, a center portion, and an end portion on each side of the center portion, the carrier body having a narrower width at the front edge than at the back edge in order to form a tapered sleeve that conforms to a shape of the forearm when the carrier is worn;

means for securing the carrier to the forearm, the securing means including means for fastening the end portions to each other when the end portions are wrapped around opposite sides of the forearm; and a strap extending across at least a portion of the center portion and attached to the top side at a plurality of locations to form an open-ended compartment that extends along the center portion in a longitudinal direction of the forearm, the compartment snugly receiving an article used in cosmetics and urging the article against the center portion to hold the article in place, an open end of the compartment being located at a distance from the front edge such that the article can project out of the compartment while remaining on the center portion.

2. The carrier of claim 1, further comprising a cover portion attached to the front edge for folding over the article in the compartment.

3. The carrier of claim 1, wherein the strap extends across the carrier body approximately parallel to the front edge.

4. The carrier of claim 1, wherein the strap is made of elastic material.

5. The carrier of claim 1, wherein strap extends fully across the center portion.

6. The carrier of claim 1, wherein the compartment has an opening at each end through which the article extends.

7. The carrier of claim 1, wherein the compartment is a pocket having a closed end and an open end through which the article is inserted.

8. The carrier of claim 1, wherein the compartment is sized to closely receive a brush handle.

9. The carrier of claim 1, further comprising a pocket aligned with the compartment for receiving a tip of the article inserted into the compartment.

10. The carrier of claim 1, wherein the means for fastening includes a hook-and-loop material.

11. The carrier of claim 1, further comprising a layer of neoprene material sewn between layers of duck cloth.

12. The carrier of claim 1, further comprising a second strap extending across at least a portion of the top side of the carrier body and attached to the top side at a plurality of locations such that a second compartment is defined for receiving and holding an article between the second strap and the center portion.

13. A carrier of articles for wearing around a forearm, the carrier comprising:

means for providing a carrier body having front and back edges, a top side, a center portion, and an end portion on each side of the center portion, the carrier body having a narrower width at the front edge than at the back edge in order to form a tapered sleeve that conforms to a shape of the forearm when the carrier is worn;

means for securing the carrier to the forearm, the securing means including means for fastening the end portions to each other when the end portions are wrapped around opposite sides of the forearm; and means, attached to the top side of the carrier body, for forming an open-ended compartment that extends along the center portion in a longitudinal direction of the forearm, the compartment snugly receiving and urging an article used in cosmetics against the center portion to hold the article in place, an open end of the compartment being located at a distance from the front edge such that the article can project out of the compartment while remaining on the center portion.

14. A method for constructing a hands-free carrier for wearing around a forearm, the method comprising:

providing a carrier body having front and back edges, a top side, an underside, a center portion, and an end portion on each side of the center portion, the carrier body having a narrower width at the front edge than at the back edge in order to form a tapered sleeve that conforms to a shape of the forearm when the carrier is worn;

attaching means for fastening to the top side of one of the end portions of the carrier body and to the underside of the other end portion of the carrier body;

attaching a strap across the top side of the carrier body at a plurality of locations to produce an open-ended compartment that extends along the center portion in a longitudinal direction of the forearm, the compartment snugly receiving an article used in cosmetics and urging the article against the center portion to hold the article in place, an open end of the compartment being located at a distance from the front edge such that the article can project out of the compartment while remaining on the center portion.

15. The method of claim 14, further comprising attaching a planar cover portion to the front edge.

16. The method of claim 14, wherein the strap extends across the carrier body approximately parallel to the front edge.

17. The method of claim 14, further comprising sewing a layer of neoprene between layers of duck cloth to produce the carrier body.

18. A cosmetics kit, comprising:

an implement used in cosmetics; and a forearm carrier for wearing on a forearm of a user and for holding the cosmetics implement, the forearm carrier comprising:

a carrier body having front and back edges, the carrier body having a narrower width at the front edge than at the back edge in order to form a tapered sleeve that conforms to a shape of the forearm when the carrier is worn, the carrier body having means for securing the carrier body to the forearm of the user; and an open-ended compartment coupled to the carrier body, the open-ended compartment being made of material that enables the compartment to expand and hold the cosmetics implement snugly when a portion of the cosmetics implement is inserted into the compartment through an open end thereof.

19. The cosmetics kit of claim 18, wherein the implement used in cosmetics is a make-up applicator.

20. The cosmetics kit of claim 19, wherein the make-up applicator is a blush brush.

21. The cosmetics kit of claim 18, wherein the implement used in cosmetics is an eyeliner applicator.

22. The cosmetics kit of claim 18, wherein the implement used in cosmetics is hair-cutting shears.

* * * * *